United States Patent [19]

Imajo

[11] Patent Number: 4,966,107

[45] Date of Patent: Oct. 30, 1990

[54] VALVE CLEARANCE ADJUSTMENT

[75] Inventor: Minoru Imajo, Yokohama, Japan

[73] Assignee: Nissan Motor Co., Ltd., Yokohama, Japan

[21] Appl. No.: 473,125

[22] Filed: Jan. 31, 1990

Related U.S. Application Data

[63] Continuation of Ser. No. 190,857, May 6, 1988, abandoned.

[30] Foreign Application Priority Data

May 8, 1987 [JP] Japan ..... 62-69561[U]

[51] Int. Cl.[5] ..... F01L 1/20

[52] U.S. Cl. ..... 123/90.45; 123/90.52

[58] Field of Search ..... 123/90.23, 90.45, 90.54, 123/90.52; 33/602

[56] References Cited

FOREIGN PATENT DOCUMENTS 2815254 7/1979 Fed. Rep. of Germany ... 123/90.45

0028501 2/1983 Japan ..... 123/90.45

OTHER PUBLICATIONS

*Chilton's Foreign Car Repair Manul*, © 1971, pp. 64, 65, 129, 130, 246, 380, 381, 562–565, 754, 873–874, 1047, 1239–1241, and A-1; Vol. 1; German, Swedish, Italian Cars.

*Primary Examiner*—Charles J. Myhre
*Assistant Examiner*—Weilun Lo
*Attorney, Agent, or Firm*—Pennie & Edmonds

[57] ABSTRACT

A valve clearance adjustment method is proposed which is effective in improving smoothness of an idle operation of a multi-cylinder internal combustion engine at a low engine speed. This method features steps of selecting a crankshaft angle where one of an intake valve and an exhaust valve is seated while the other valve is being lifted from its seated position, and conducting the adjustment of a valve clearance for the seated valve at this crankshaft angle.

4 Claims, 8 Drawing Sheets

VALVE CLEARANCE ADJUSTMENT

This is a continuation, of application Ser. No. 07/190,857, filed May 6, 1988, now abandoned.

BACKGROUND OF THE INVENTION

The present invention relates to a valve clearance adjustment for improving smoothness of an idle operation of a multi-cylinder internal combustion engine, and more particularly to a method of and an apparatus for effecting a valve clearance adjustment for improving smoothness of an idle operation of a multi-cylinder internal combustion engine. The present invention also concerns an indicator device for indicating a crankshaft angle where adjustment of a valve clearance is to be conducted.

In a certain conventional multi-cylinder internal combustion engine, it is necessary to conduct adjustment of a valve clearance for each of intake and exhaust valves in order to compensate for a change in a valve clearance.

A conventional valve clearance adjustment method is described hereinafter taking a reference to FIGS. 10–12. FIGS. 10 and 11 show a front end portion of a conventional multi-cylinder internal combustion engine including a crankshaft pulley 1 fixed to a front end of a crankshaft. On the outer peripheral portion of the pulley 1 is a TDC mark 2. On a stationary member in the form of a timing belt cover 3 is a timing indicator 4. When the TDC mark 2 meets with the timing indicator 4 as is the position shown in FIGS. 10 and 11, the engine crankshaft assumes a crankshaft angle where one of the engine cylinders, for example, No. 4 cylinder, is at its compression top dead center. In the case of a four cylinder in-line internal combustion engine, No. 1 cylinder is at its compression top dead center after rotating the crankshaft through 360° from the above-mentioned crankshaft angle position. These crankshaft angles are conventionally selected as positions where adjustment of a valve clearance is conducted.

The valve clearance adjustment schedule is more precisely described taking a reference to FIG. 12. In this Figure, positions where intake and exhaust valves are adjusted are designated. For example, NO. 1 IN designates a compression top dead center where the intake valve in No. 1 cylinder is to be adjusted. Describing in detail, at the compression top dead center of No. 1 cylinder where both the intake and exhaust valves in this cylinder are seated, the valve clearance adjustment is conducted on the intake and exhaust valves in No. 1 cylinder, the intake valve in No. 2 cylinder, the exhaust valve in No. 3 cylinder. Subsequently, at the compression top dead center of No. 4 cylinder when the TDC mark 2 meets again with the timing idicator 4 after rotating the crankshaft through 360 degrees, the valve clearance adjustment is conducted on the intake and exhaust valves in No. 4 cylinder, the exhaust valve in No. 2 cylinder, and the intake valve in No. 3 cylinder.

Referring back to FIGS. 10 and 11, the above-mentioned crankshaft pulley 1 is provided also with six pulley marks 5 which are angularly spaced by 5° from the TDC mark 2. The pulley marks 5 are used during inspection and adjustment of ignition timing in the No. 1 cylinder.

A problem caused by this conventional valve clearance adjustment method is explained.

For lifting the intake and exhaust valves in accordance with a predetermined schedule determined with respect to crankshaft angle of the engine crankshaft, a valve train for the above-mentioned four-cylinder in-line engine includes a single camshaft for activating both intake and exhaust valves. When the intake or exhaust valve is being lifted, the reaction due to compression of a valve spring acts on the camshaft via a rocker arm, causing a deflection of the camshaft. Thus, when the exhaust valve in one cylinder is lifted, a valve clearance provided for the adjacent intake valve in the same cylinder increases more than it does when the associated exhaust valve is not lifted.

FIG. 13 shows a valve lift diagram of each of the intake and exhaust valves in No. 1 and No. 4 cylinders when the valve clearance adjustment is conducted at the compression top dead center position of the No. 1 cylinder and at the compression top dead center position of the No. 4 cylinder in accordance with the conventional method. The valve lift is measured in terms of the lift of a rocker arm of the associated valve. In this Figure, EO designates an opening timing of an exhaust valve, EC designates a closing timing of an exhaust valve, IO designates an opening timing of an intake valve, and IC designates a closing timing of an intake valve. A valve clearance is adjusted to 0.30 mm at 80° C., and the measurement is made at 80° C. It has been confirmed that an increase in the valve clearance is substantially noticeable immediately before and after the valve overlap in the No. 4 cylinder. As a result, the valve overlap in the No. 4 cylinder is less than that in the No. 1 cylinder by 10° as will be readily understood from FIG. 13. Thus, the No. 1 to No. 4 cylinders produce uneven torque, causing unstable idling of the engine.

In the above-mentioned example, the virtual valve clearance of each of the intake and exhaust valves in each of the No. 1 cylinder and No. 4 cylinder is increased as compared to that at the time of the valve adjustment. This causes the valve overlap to vary. This variation in the valve overlap due to the resilient deflection of the camshaft is not even over all of the cylinders, thus bringing about an uneven overlap among the cylinders. This results in instable idling of the engine.

An object of the present invention therefore is to provide a valve clearance adjustment method which improves smoothness of an idle operation of a multi-cylinder internal combustion engine.

Another object of the present invention is to provide an indicator device to be used for carrying out the above-mentioned valve clearance adjustment method.

SUMMARY OF THE INVENTION

According to the present invention, a valve clearance adjustment method is provided with the steps of selecting a crankshaft angle where one of an intake valve and an exhaust valve which are arranged with respect to one of the engine cylinders which are disposed at the opposite ends of an in-line arrangement of the engine cylinders is seated while the remaining one of said intake and exhaust valve of said one cylinder is being lifted from its seated position; and conducting adjustment of a valve clearance for said one valve at said crankshaft angle.

According to another aspect of the present invention, a valve clearance adjustment method is provided with the steps of selecting a crankshaft angle where one of an intake valve and an exhaust valve which are arranged with respect to one of the engine cylinders which is subject to a deflection of the camshaft caused by lifting of the other valve is seated while the remaining one of said intake and exhaust valve of said one cylinder is being lifted from its seated position; and conducting adjustment of a valve clearance for said one valve at said crankshaft angle.

According to still another aspect of the present invention, a valve clearance adjustment method is provided with the steps of:

providing a timing indicator on a stationary member disposed adjacent to a predetermined member movable in timed relationship with the engine crankshaft;

providing a mark on said predetermined member at such a location that when said mark meets with said timing indicator, said engine crankshaft assumes a crankshaft angle where one of an intake valve and an exhaust valve which are arranged with respect to one of the engine cylinders which are disposed at the opposite ends of an in-line arrangement of the engine cylinders is seated while the remaining one of said intake and exhaust valve of said one cylinder is being lifted from its seated position; and conducting adjustment of a valve clearance for said one valve when said mark meets with said timing indicator.

DETAILED DESCRIPTION OF THE INVENTION

Figure 1:
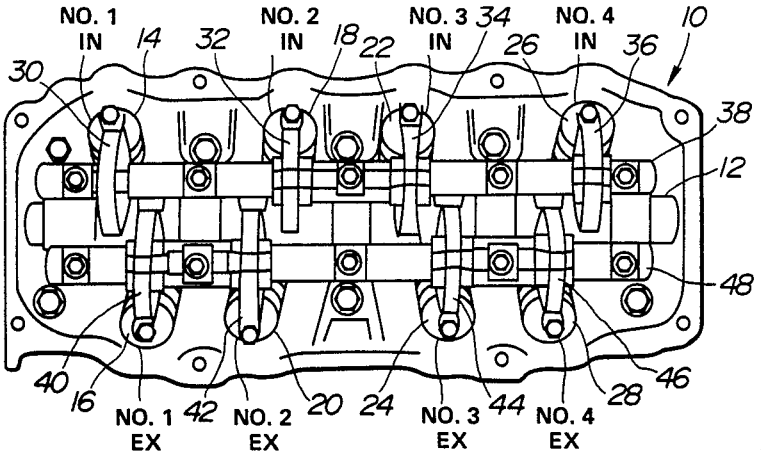
FIG. 1 is a diagrammatic top plan view of a multi-cylinder internal combustion engine showing a valve train.

Referring to FIG. 1, there is shown a conventional four-cylinder in-line internal combustion engine 10 which comprises a valve train which includes a camshaft 12 driven by a crankshaft, not shown. Arranged in a No. 1 cylinder, which is disposed at a front end of an in-line arrangement of cylinders, are a No. 1 intake valve 14 and a No. 1 exhaust valve 16. Arranged next to the No. 1 cylinder is a No. 2 cylinder which a No. 2 intake valve 18 and a No. 2 exhaust valve 20 are arranged in. A No. 3 cylinder is disposed next to the No. 2 cylinder and provided with a No. 3 intake valve 22 and a No. 3 exhaust valve 24. Disposed at the opposite or rear end of the in-line arrangement is a No. 4 cylinder which a No. 4 intake valve 26 and a No. 4 exhaust valve 28 are arranged in. For the intake valves, there are four rocker arms 30, 32, 34 and 36 arranged on a rocker arm shaft 38. For the exhaust valves, there are four rocker arms 40, 42, 44 and 46 arranged on a rocker arm shaft 48. The rocker arms 30, 32, 34, 36, 40, 42, 44 and 46 have one arm in abutting engagement with the associated cam lobes formed on the camshaft 12. The intake and exhaust valves 30, 32, 34, 36, 40, 42, 44 and 46 have valve springs, respectively, and biased toward their seated positions, respectively.

Figure 2:
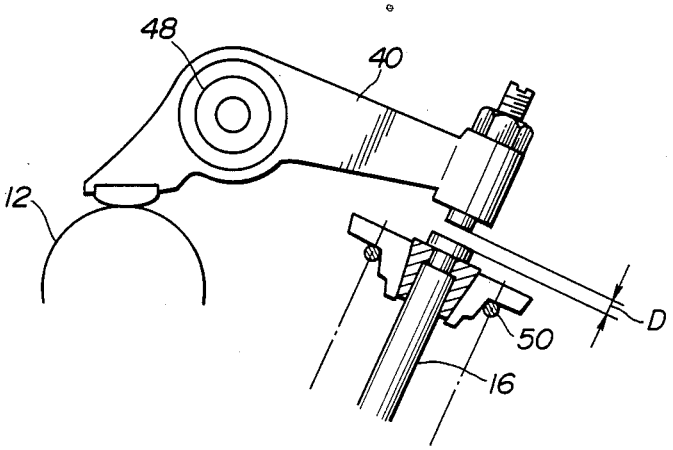
FIG. 2 is a diagrammatic side elevation of a rocker arm in operative association with a camshaft and a valve stem.

FIG. 2 shows an arrangement of the rocker arm 40 in operative association with the camshaft 12 and the No. 1 exhaust valve 16 provided with a valve spring 50 when the No. 1 exhaust valve 16 is seated. As best seen in FIG. 2, a valve clearance D is provided between the rocker arm 40 and the associated exhaust valve 16. Likewise, a valve clearance is provided between each of the other rocker arms and the associated valve when the latter is seated.

Figure 3:
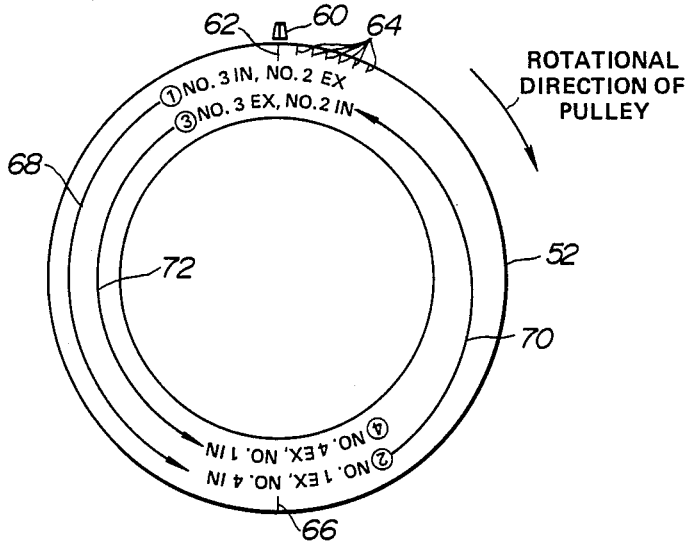
FIG. 3 is a front elevation of a crankshaft pulley where various marks are formed in accordance with a first embodiment of the present invention.

Attached to the front end of the crankshaft of the engine 10 is a crankshaft pulley 52 as shown in FIG. 3. Referring to FIG. 3, a timing indicator 60 on a timing belt cover is shown. Formed on the outer peripheral portion of the crankshaft pulley 52 are a TDC mark 62 and six pulley marks 64. When the TDC mark 62 meets with the timing indicator 60, the engine crankshaft assumes a crankshaft angle where the No. 4 cylinder assumes its compression top dead center and the No. 1 cylinder assumes its overlap top dead center. When the TDC mark 62 meets with the timing indicator 60 after rotating the crankshaft pulley 52 in the direction of an arrow in FIG. 3 through 360 degrees, the No. 4 cylinder assumes its overlap top dead center and No. 1 cylinder assumes its compression top dead center. At a position which is displaced angularly through 180 degrees from the TDC mark 62 is provided a BDC mark 66. When the BDC mark 66 meets with the timing indicator 60, the No. 4 cylinder assumes its bottom dead center during the exhaust phase and the No. 1 cylinder assumes its bottom dead center during the intake phase. When the BDC mark 66 meets with the timing indiator 60 again after rotating the crankshaft pulley 52 through 360 degrees in the direction of the arrow, the No. 4 cylinder assumes its bottom dead center during the intake phase and the No. 1 cylinder assumes its bottom head center during the exhaust phase.

Figure 4:
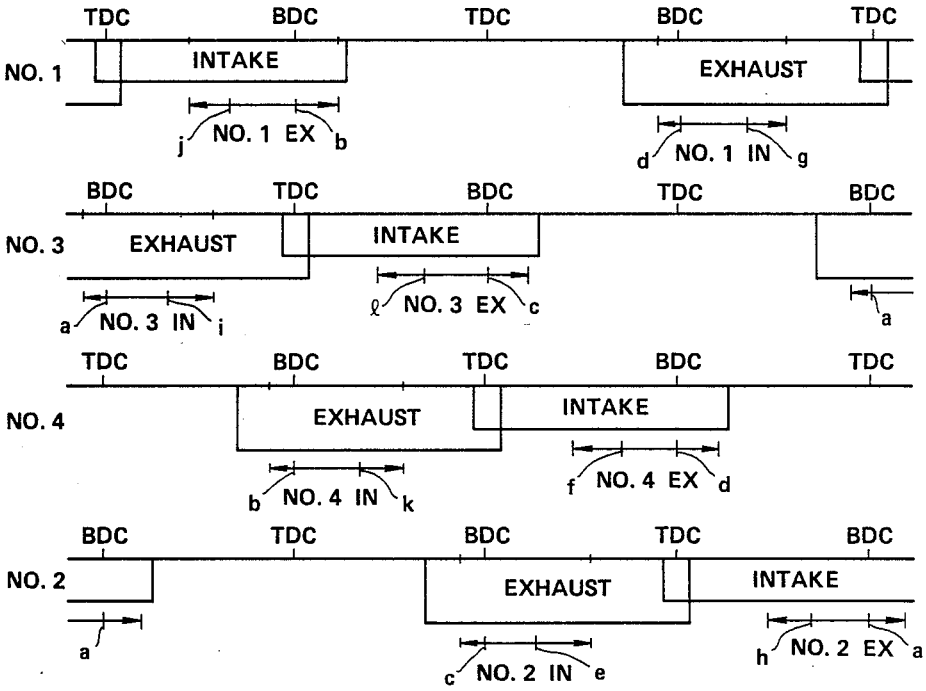
FIG. 4 is a time chart showing valve clearance adjustment positions for the intake and exhaust valves in each cylinder in accordance with the present invention.

Referring also to the time chart shown in FIG. 4, since the No. 3 intake valve is seated when the No. 3 exhaust valve is lifted at the compression top dead center of the No. 4 cylinder, while the No. 2 exhaust valve is seated when the No. 2 intake valve is lifted, a first valve clearance adjustment mark "NO. 3 IN, NO. 2 EX" is labelled near the TDC mark 62. This first valve clearance adjustment mark indicates a crankshaft angle position where a valve clearance for the intake in No. 3 cylinder and a valve clearance for the exhaust valve in No. 2 cylinder is to be adjusted. When the BDC mark 66 meets with the timing indicator 60 after rotation of the crankshaft pulley 52 in the direction of the arrow through 180 degrees, the No. 1 exhaust valve is seated when the No. 1 intake valve is lifted, while the No. 4 intake valve is seated when the No. 4 exhaust valve is lifted, a second valve clearance adjustment mark "NO. 1 EX, No. 4 IN" is labelled near the BDC mark 66. This second valve clearance adjustment mark indicates a crankshaft angle where a valve clearance for the exhaust valve in No. 1 cylinder and a valve clearance for the intake valve in No. 4 cylinder is to be adjusted. Further rotation of the crankshaft pulley 52 in the same direction through 180 degrees causes the TDC mark 62 to meet with the timing indicator 60 again. At this position, the No. 3 exhaust valve is seated when the No. 3 intake valve is lifted, while the No. 2 intake valve is seated when the No. 2 exhaust valve is lifted so that a third valve clearance adjustment mark "NO. 3 EX, NO. 2 IN" is labelled below the first valve clearance adjustment mark "NO. 3 IN, NO. 2 EX." This third valve clearance adjustment mark indicates a crankshaft angle where the exhaust valve in the No. 3 cylinder and the intake valve in the No. 2 cylinder is to be adjusted. Further rotation of the crankshaft pulley 52 in the same direction through 180 degrees causes the BDC mark 66 to meet again with the timing indicator 60. At this position, the No. 1 intake valve is seated when the No. 1 exhaust valve is lifted, while the No. 2 exhaust valve is seated when the No. 2 intake valve is lifted so that a fourth valve clearance adjustment mark "NO. 4 EX, NO. 1 IN" is labelled below the second valve clearance adjustment mark "NO. 1 EX, NO. 4 IN." This last and fourth valve clearance adjustment mark indicates a crankshaft angle where a valve clearance for the exhaust valve in the No. 4 cylinder and a valve clearance for the intake valve in the No. 1 cylinder is to be adjusted. Also labelled on the crankshaft pulley 52 are three arrows 68, 70 and 72 which indicate the sequence of adjustment of a valve clearance. The labeling of these arrows 68, 70 and 72 is not essential to the invention, however.

As will be readily understood from FIG. 4, according to the valve clearance adjustment method as above, the intake valve in each cylinder is subject to a valve clearance adjustemnt when the cylinder assumes a position 180 degrees before its valve overlap top dead center (TDC), while the exhaust valve in each cylinder is subject to a valve clearance adjustment when the particular cylinder assumes a position 180 degrees after its valve overlap top dead center (TDC). Therefore, in the state where one of the exhaust valve and intake valve is being lifted and the reaction due to the valve spring for the lifted valve is applied to the camshaft, the other valve is subject to a valve clearance adjustment, so that any ill effect due to the resilient deflection under the reaction of the valve spring and the provision of the clearance around journal of the camshaft can be eliminated.

Regarding the range in a crankshaft angle where the adjustment of a valve clearance of the intake and exhaust valves in each of the cylinders may be allowed, it is essential that the adjustement of one of the intake and exhaust valves be carried out while the other is being lifted. Preferably, a crankshaft angle ranging from 80° C. to 200° C. before the compression TDC is suitable for the intake valve, while a crankshaft angle ranging from 80° C. to 220° C. after the compression TDC is suitable for the exhaust valve. These ranges are illustrated by double-headed arrows in FIG. 4. The crankshaft angles which have been selected, according to the above-mentioned embodiment, as positions for the valve clearance adjustment are illustrated at a, b, c and d in FIG. 4.

Figure 5:
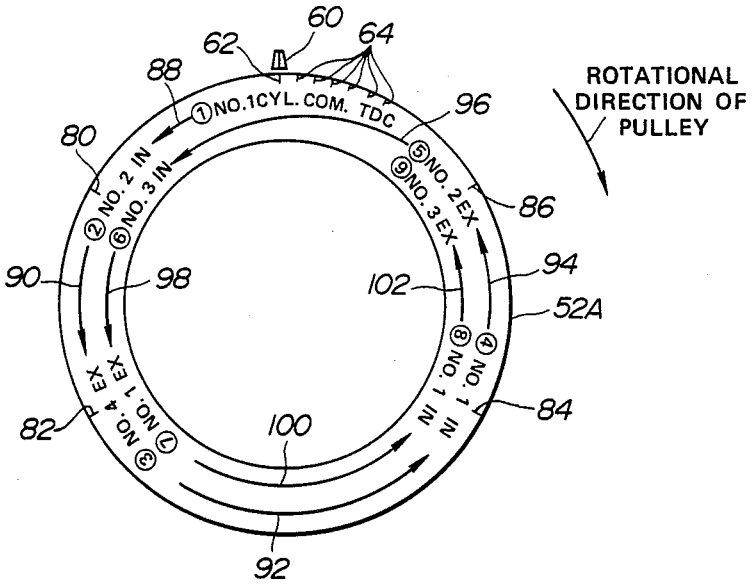
FIG. 5 is a front elevation of a crankshaft pulley where various marks are formed in accordance with a second embodiment of the present invention.

FIG. 5 shows a crankshaft pulley 52A used in a second embodiment, which is used in a different manner from the use of the crankshaft pulley 52 in that initially it is rotated until a TDC mark 62 meets with a timing indicator 60 and a No. 1 cylinder assumes its compression top dead center (TDC). At a position angularly spaced 60° counterclockwise, as viewed in FIG. 5, from the TDC mark 62 is a first valve adjustment mark 80. At a position angularly spaced 60° further in the same direction is a second valve clearance adjustment mark 82. At a position angularly spaced 120° further in the same direction is a third valve clearance adjustment mark 84. At a position angularly spaced 60° further in the same direction is a fourth valve adjustment mark 86. What valve is to be subject to a valve clearance adjustment is labelled below the corresponding one of the valve clearance adjustment marks 80, 82, 84 and 86. Labelled below the valve clearance adjustment mark 80 is a mark "NO. 2 IN" indicating that an intake valve in a No. 2 cylinder is to be subject to a valve clearance adjustment. Labelled below the valve adjustment mark 82 is a mark "NO. 4 EX" indicating that an exhaust valve in a No. 4 cylinder is to be subject to a valve clearance adjustment. Labelled below the valve adjustment mark 84 is a mark "NO. 1 IN" indicating that an intake valve in a No. 1 cylinder is to be subject to a valve clearance adjustment. Labelled below the valve adjustment 86 is a mark "NO. 2 EX" indicating that an exhaust valve in the No. 2 cylinder is to be subject to a valve clearance adjustment. Labelled below the mark "No. 2 IN" is a mark "NO. 3 IN" indicating that an intake valve in a No. 3 cylinder is to be subject to a valve clearance adjustment. Labelled below the mark "NO. 4 EX" is a mark "No. 1 EX" indicating that an exhaust valve in the No. 1 exhaust valve is to be subject to a valve clearance adjustment. Labelled below the mark "NO. 1 IN" is a mark "NO. 4 IN" indicating that an intake valve in the No. 4 cylinder is to be subject to a valve clearance adjustment. Lastly, labelled below the mark "NO. 2 EX" is a mark "NO. 3 EX" indicating that an exhaust valve in the No. 3 cylinder is to be subject to a valve clearance adjustment. The crankshaft angles which have been selected according to this embodiment as positions for a valve clearance adjustment are illustrated at e, f, g, h, i, j and k in FIG. 4. It will be noted that the valve clearance adjustments for all of the valves are made at eight positions arranged within a range from 0° to 720° in crankshaft angle after the compression TDC of the No. 1 cylinder.

Although not specifically described, it will be readily understood that the particular valve is subject to a valve clearance adjustment at the position where the associated one of the marks 80, 82, 84 and 86 meets with the timing indicator 60. In order to indicate the sequence of the valve clearance adjustment, arrows 88, 90, 92, 94, 96, 98, 100 and 102 are labelled although the labelling of these arrows is not essential to the invention.

Figure 6:
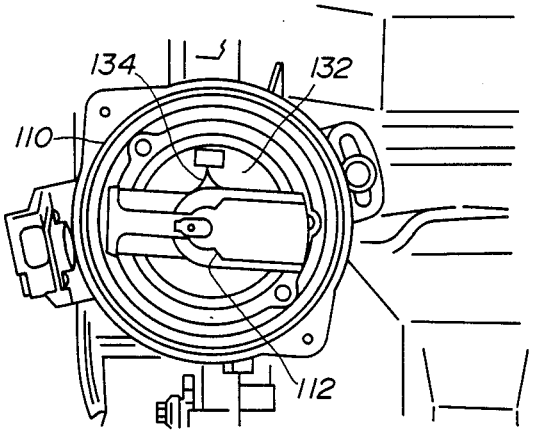
FIG. 6 is a front elevation of a distributor where the present invention is embodied as a third embodiment.
Figure 7:
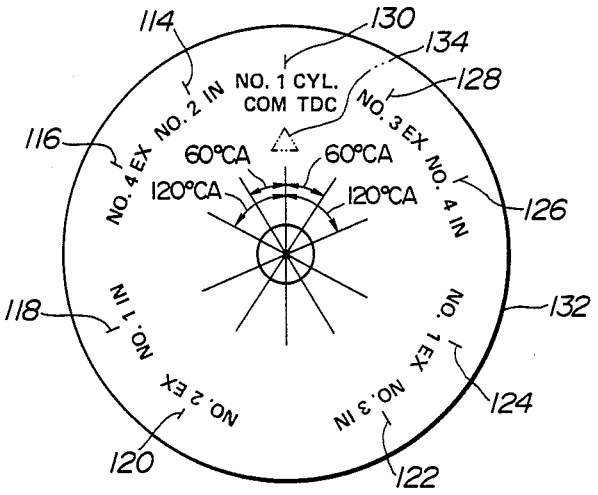
FIG. 7 is a front elevation of a cover for an angle plate for a crankshaft angle sensor provided within the distributor where various marks are formed in accordance with the third embodiment of the present invention.

Referring to FIGS. 6 and 7, a third embodiment is described. According to this embodiment, a distributor 110 is used to indicate positions where each of intake and exhaust valves is to be subject to a valve clearance adjustment. The distributor 110 comprises a rotor 112 so designed as to make a turn during rotation of a crankshaft through 720° so that eight valve clearance adjustment marks 114, 116, 118, 120, 122, 124, 126 and 128 are provided in addition to a TDC mark 130 on an angle plate cover 132 for a crankshaft angle sensor. An indicator 134 is formed on the rotor 112. Describing the arrangement of the marks illustrated in FIG. 7, the valve adjustment mark 114 is disposed at a position angularly spaced through 30° counterclockwise from the mark 130. This angle corresponds to 60° in crankshaft angle (60° CA). The valve adjustment mark 116 is disposed at a position angularly spaced 60° counterclockwise from the mark 130. This angle corresponds to 120° in crankshaft angle (120° CA). The valve adjustment mark 118 is disposed at a position angularly spaced further through 60° from the mark 116. The mark 120 is disposed at a position angularly spaced 30° from this mark 118. The mark 122 is disposed at a position angularly spaced 60° from the mark 120. The mark 124 is disposed at a position angularly spaced 30° from the mark 122. The mark 126 is disposed at a position angularly spaced 60° from the mark 124. The mark 128 is disposed at a position angularly spaced 30° from the mark 126. Since as viewed in FIG. 7, the indicator 134 rotates counterclockwise and makes a single turn during rotation of the crankshaft through 720°, the positions where the valve clearance adjustment of the intake and exhaust valves are made are the same as those selected by the second embodiment.

Figure 8:
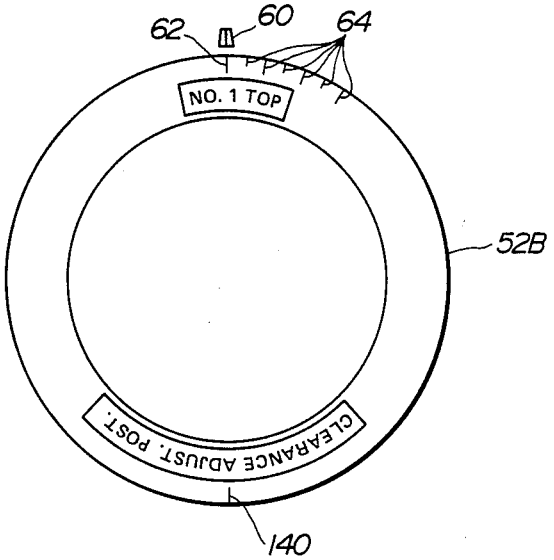
FIG. 8 is a front elevation of a crankshaft pulley where various marks are formed in accordance with a fourth embodiment of the present invention.
Figure 9:
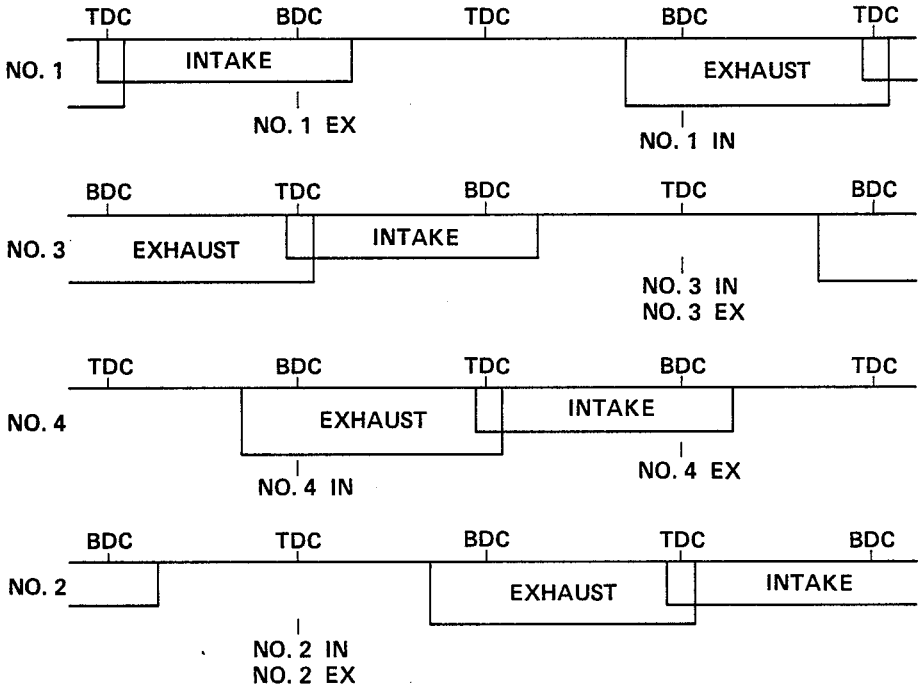
FIG. 9 is a time chart showing valve clearance adjustment positions for the intake and exhaust valves in each cylinder in accordance with the fourth embodiment of the present invention.
Figure 10:
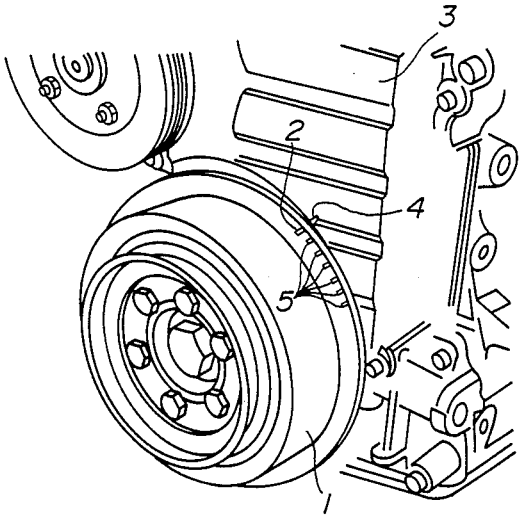
FIG.10 (PRIOR ART)
FIG. 10 is a fragmentary perspective view of a front end of a multi-cylinder internal combustion engine showing the before discussued valve clearance adjustment indicator.
Figure 11:
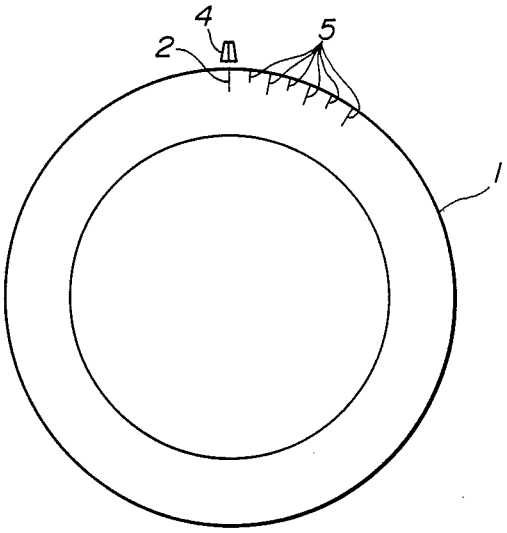
FIG.11 (PRIOR ART)
FIG. 11 is a front elevation of the crankshaft pulley shown in FIG. 10.
Figure 12:
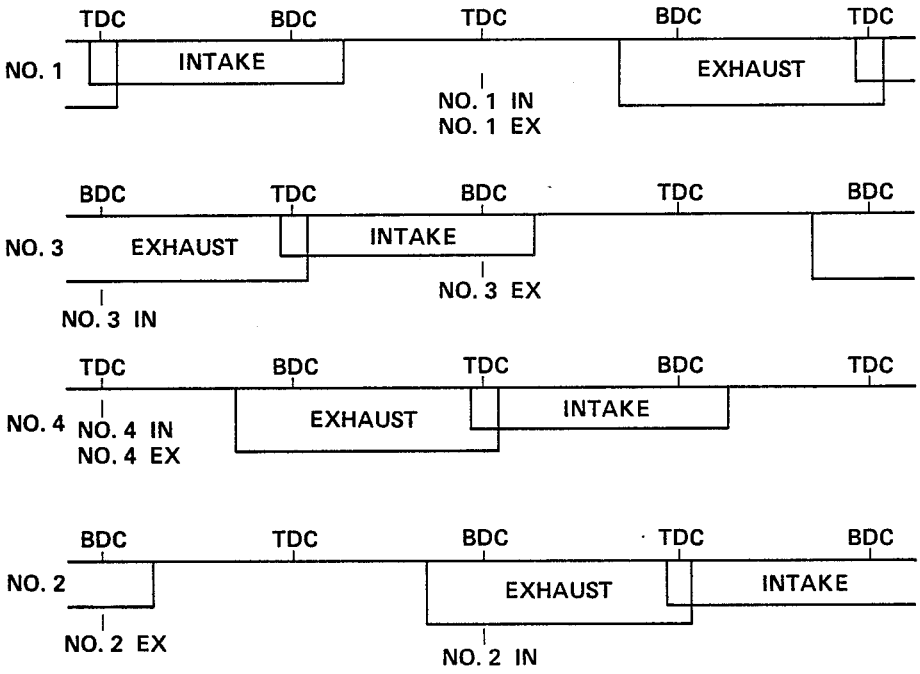
FIG. 12 (PRIOR ART)
FIG. 12 is a time chart showing valve clearance adjustment positions for the intake and exhaust valves in each cylinder in accordance with the conventional art which has been discussed before in connection with FIGS. 10 and 11.
Figure 13:
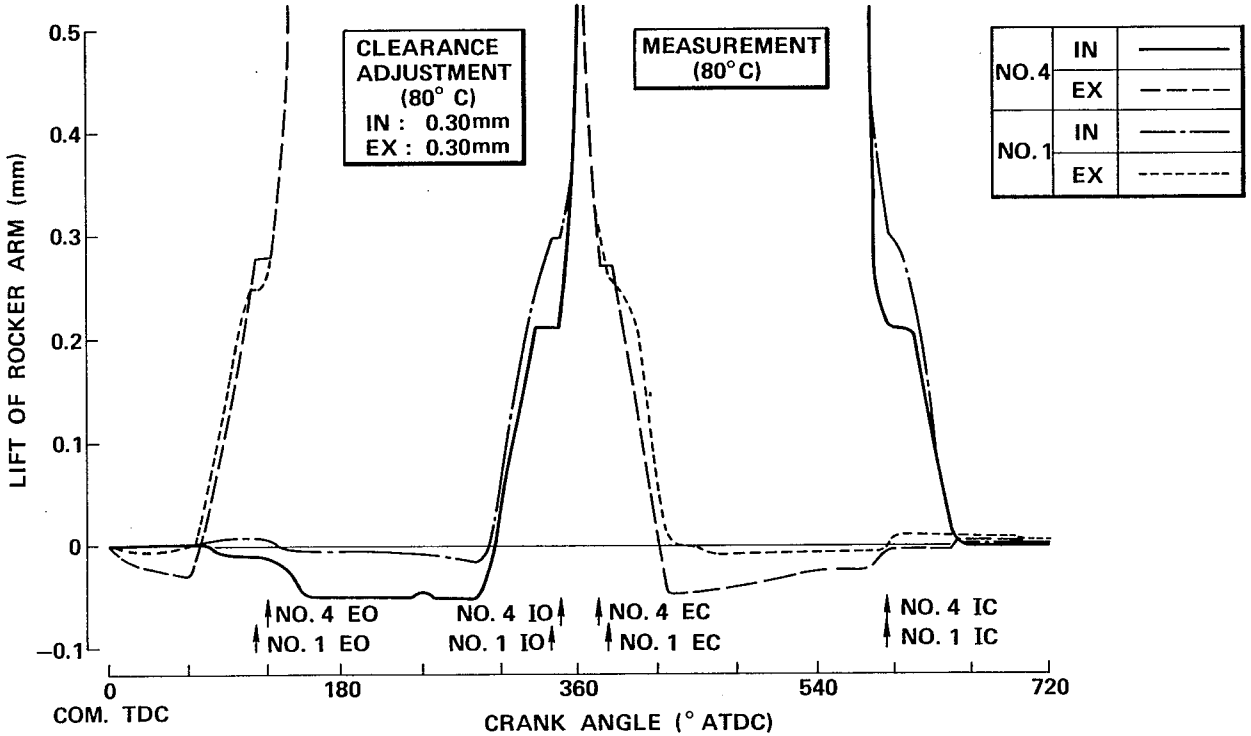
FIG. 13 (PRIOR ART)
FIG. 13 is a valve lift diagram of intake and exhaust valves in the No. 1 and No. 4 cylinders of the four-cylinder in-line internal combustion engine which valve clearances are adjusted in accordance with the conventional valve clearance adjustment method.

Referring to FIGS. 8 and 9, a fourth embodiment is described wherein the above-mentioned valve clearance adjustment of each of intake and exhaust valves in one engine cylinder is applied to the intake and exhaust valves in No. 1 and No. 4 cylinders which are disposed at both ends of an in-line arrangement of the engine cylinders. In this embodiment, a valve clearance adjustment is made for each of the intake and exhaust valves in No. 2 and No. 3 cylinders which are disposed between the No. 1 and No. 4 cylinders (see FIG. 1) when both of the intake and exhaust valves in one cylinder are seated and thus there is no reaction of the valve spring applied to the camshaft.

As shown in FIG. 8, a crankshaft pulley 52B used in this embodiment has a TDC mark 62 and pulley marks 64 similarly to those provided on the crankshaft pulley 52A. Initially, the crankshaft pulley 52B is rotated until the TDC mark 62A meets with a timing indicator 60 and the No. 1 cylinder assumes its overlap top dead center. Labelled below this mark 62 is an indication mark "NO. 1 TOP" indicating that the No. 1 cylinder assumes its overlap or compression top dead center when the mark 62A meets with the timing indicator 60. Provided at a position angularly spaced 180° CA from the TDC mark 62 is a valve clearance adjustment mark 140. Labelled adjacent the mark 140 is an indication mark "CLEARANCE ADJUST. POST." indicating that this is a position where a valve clearance adjustment is to be made.

Explaining the manner regarding the valve clearance adjustment, what you have to do is to rotate the crankshaft pulley 52B until the TDC mark 62 meets with the timing indicator 60 and the No. 1 cylinder assumes its overlap top dead center. Then, the crankshaft pulley 52B is rotated counterclockwise through 180° until the valve adjustment mark 140 meets with the timing indicator 60. At this position, a valve clearance adjustment is made for an exhaust valve in No. 1 cylinder, intake and exhaust valves in No. 2 cylinder, and an intake valve in No. 4 cylinder. Subsequently, the crankshaft pulley 52B is rotated further through 360° CA until the valve clearance adjustment mark 140 meets with the timing indicator 60 again. At this position, a valve clearance adjustment is made for an intake valve in No. 1 cylinder, an exhaust valve in No. 4 cylinder and both intake and exhaust valves in No. 3 cylinder. FIG. 9 shows the timing when a valve clearance adjustment should be made for each of the intake and exhaust valves. As will be readily understood from FIG. 9, the first of two positions selected as position where a valve clearance adjustment is to be made is a bottom dead center (BDC) of the No. 1 cylinder during its intake phase, while the other position is a bottom dead center (BDC) of the No. 1 cylinder during its exhaust phase. It will also be understood that the valve clearance adjustment for the intake valve in the No. 1 cylinder is made at a position 180° CA before its overlap top dead center, while the valve clearance adjustment for the exhaust valve in the No. 1 cylinder is made at a position 180° CA after its overlap top dead center. Similarly, the valve adjustment for the intake valve in the No. 4 cylinder is made at a position 180° CA before its overlap top dead center, while the valve adjustment for the exhaust valve in the No. 4 cylinder is made at 180° CA after its overlap top dead center.

This embodiment is particularly suitable for use in the internal combustion engine as shown in FIG. 1 where the deflection of the camshaft due to the reaction of the valve spring of a lifted valve near the overlap top dead center is not negligible in the No. 1 cylinder and No. 4 cylinder as compared to that in the No. 2 cylinder and No. 3 cylinder. This is because the clearances provided at journals arranged at the opposite ends of the camshaft are comparatively large as compared to the other journals for the camshaft. In other words, the amount of deflection of the camshaft due to the reaction of the valve spring of a lifted valve is not negligible for the No. 1 cylinder and No. 4 cylinder, whereas the amount of deflection of the camshaft due to the reaction of the valve spring of a lifted valve is negligible. Thus, a valve clearance adjustment is made for one valve upon the camshaft being stressed by the valve spring of the other valve lifted and this adjustment method is applied only to intake and exhaust valves of the No. 1 and No. 4 cylinders.

From the previous description of the various embodiments, it will now be appreciated that a valve clearance adjustment proposed by this application is quite effective in eliminating ill effect on a valve clearance caused by deflection of the camshaft due to the reaction of valve spring and displacement of the camshaft due to the provision of clearances provided at the camshaft bearings.

It will now be understood that the present invention has made it possible for a multi-cylinder internal combustion engine to idle at a sufficiently low engine speed. According to the present invention, an excessive increase in valve clearance at near the overlap top dead center does not occur, resulting in a considerable reduction in tappet noise which was encountered in the prior art due to an excessive increase in valve clearance. Since the stable idling of the engine at low speed has been given by the present invention, the possibility of engine stall at low engine speeds is prevented, the fuel is saved considerablly, and the emission level is reduced.

What is claimed is:

1. A method for adjusting a valve clearance of a multicylinder internal combustion engine, said engine including a plurality of intake and exhaust valves, a crankshaft, spring means to close each said valve, and a camshaft which opens each said valve and is driven synchronously by said crankshaft, wherein said method compensates for a deflection of said camshaft caused by a reaction force exerted against said camshaft by said spring means which closes each said valve, comprising the steps of:

(a) rotating said crankshaft to a predetermined position such that a predetermined one of said valves, corresponding to a predetermined cylinder of said engine, is fully closed and at least one other of said valves which corresponds to said cylinder is fully open;

(b) adjusting a valve clearance of said predetermined valve;

(c) repeating rotating and adjustive steps until a valve clearance has been adjusted for each and every of said plurality of valves thereby compensating for camshaft deflections.

2. A method for adjusting a valve clearance of an in-line multicylinder internal combustion engine, said engine including a plurality of cylinders including a first predetermined cylinder disposed at one end of an in-line arrangement and a second predetermined cylinder disposed at the opposite end of said in-line arrangement, and a plurality of intake and exhaust valves, a crankshaft, spring means to close each said valve, and a camshaft which opens each said valve and is driven synchronously by said crankshaft, wherein said method compensates for a deflection of said camshaft caused by reaction forces exerted against said camshaft by said spring means which closes each said valve, comprising the steps of:

(a) rotating said crankshaft to a predetermined position such that a predetermined one of said valves, corresponding to one of said first and second predetermined cylinders of said engine, is fully closed and at least one other of said valves which corresponds to said one cylinder is fully open;

(b) adjusting a valve clearance of said predetermined valve;

(c) repeating rotating and adjustive steps until a valve clearance has been adjusted for each and every said plurality of valves which correspond to said first and second predetermined cylinders so as to compensate for the deflection of said camshaft due to said reaction forces.

3. A valve clearance adjustment apparatus for compensating for an operational deflection of a camshaft of a multicylinder internal combustion engine, said engine including respective intake and exhaust valves for each cylinder, a crankshaft, said crankshaft synchronously driving said camshaft to open said valves, and spring means for each valve to urge said valves to close, said adjustment apparatus comprising:

indicating means having identification means for indicating a fully closed position of each and every valve of at least one cylinder of said engine at which at least one other valve of the same cylinder is fully open, wherein said each and every valve clearance in said at least one cylinder of said engine is adjusted when said valve is in said fully closed position so as to compensate for said camshaft deflections caused by a respective reaction force of said spring means.

4. A valve clearance adjustment apparatus for compensating for an operational deflection of a camshaft of a multicylinder internal combustion engine, said engine including respective intake and exhaust valves for each cylinder, a crankshaft, said crankshaft synchronously driving said camshaft to open said valves, and spring means for each valve to urge said valves to close, said adjustment apparatus comprising:

indicating means for indicating a fully closed position of each and every valve of at least one cylinder of said engine at which at least one other valve of the same cylinder is fully open, said indicating means including at least one indication mark disposed on a rotating member driven so as to be synchronous with said camshaft and a stationary indication disposed adjacent to said rotating member, wherein said each and every valve clearance in said at least one cylinder of said engine is adjusted when said valve is in said fully closed position so as to compensate for said camshaft deflections caused by a respective reaction force of said spring means.

* * * * *